US010506872B2

(12) United States Patent
Kruger et al.

(10) Patent No.: US 10,506,872 B2
(45) Date of Patent: Dec. 17, 2019

(54) WORK STATION WITH IN-WALL HEIGHT-ADJUSTMENT MECHANISM

(71) Applicant: Teknion Limited, Toronto (CA)

(72) Inventors: Paul Fredrick Kruger, Toronto (CA); Benjamin Kevin Fogarty, Mississauga (CA); Adam Douglas Haworth Sinclair, Mount Albert (CA)

(73) Assignee: Teknion Limited, Toronto (CA)

( * ) Notice: Subject to any disclaimer, the term of this patent is extended or adjusted under 35 U.S.C. 154(b) by 0 days.

(21) Appl. No.: 15/992,600

(22) Filed: May 30, 2018

(65) Prior Publication Data

US 2018/0344024 A1 Dec. 6, 2018

Related U.S. Application Data

(60) Provisional application No. 62/512,310, filed on May 30, 2017.

(51) Int. Cl.

| | |
|---|---|
| ***A47B 9/06*** | (2006.01) |
| ***A47B 21/02*** | (2006.01) |
| ***A47B 17/02*** | (2006.01) |
| ***A47B 9/04*** | (2006.01) |
| *A47B 83/00* | (2006.01) |
| *A47B 5/00* | (2006.01) |
| *A47B 96/14* | (2006.01) |

(52) U.S. Cl.

CPC ..... *A47B 9/06* (2013.01); *A47B 9/04* (2013.01); *A47B 17/02* (2013.01); *A47B 21/02* (2013.01); *A47B 5/00* (2013.01); *A47B 83/001* (2013.01); *A47B 96/1425* (2013.01); *A47B 2083/005* (2013.01); *A47B 2200/0046* (2013.01); *A47B 2200/0056* (2013.01); *A47B 2200/12* (2013.01)

(58) Field of Classification Search

CPC .. A47B 9/06; A47B 9/04; A47B 17/02; A47B 5/00; A47B 2083/005; A47B 2200/0046; A47B 2200/0056; A47B 2200/12; A47B 2200/0066

USPC ..... 108/144.11, 147.11, 147, 42, 50.01

See application file for complete search history.

(56) References Cited

U.S. PATENT DOCUMENTS 4,590,865 A * 5/1986 Rutsche ..... A47B 9/04 108/1
4,762,072 A * 8/1988 Boundy ..... A47B 21/06 108/50.02
4,969,403 A * 11/1990 Schwartz ..... A47B 5/00 108/147

(Continued)

*Primary Examiner* — Jose V Chen
(74) *Attorney, Agent, or Firm* — Bereskin & Parr LLP/S.E.N.C.R.L., s.r.l.

(57) ABSTRACT

A height-adjustable work station includes (a) a partition wall having an internal wall frame and axially opposed first and second exterior wall surfaces mounted to the wall frame, the first and second exterior wall surfaces spaced axially apart by a wall thickness; (b) a carriage support located within the wall thickness and mounted to the wall frame, the carriage support including a vertical track; (c) a carriage mounted to the carriage support in sliding engagement with the track; (d) a work surface assembly movably supported by the carriage on a first side of the wall; and (e) a linear actuator mounted within the wall thickness and coupled to the carriage, the actuator configured to vertically translate the carriage along the track for facilitating height adjustment of the work surface assembly.

11 Claims, 10 Drawing Sheets

(56) References Cited

U.S. PATENT DOCUMENTS

| | | | | | |
|---|---|---|---|---|---|
| 5,199,778 | A * | 4/1993 | Aoki | A47B 57/32 | 108/147 |
| 5,265,952 | A * | 11/1993 | Greshem | A47B 83/001 | 108/147 |
| 5,373,793 | A * | 12/1994 | Crossman | A47B 9/04 | 108/42 |
| 5,531,168 | A * | 7/1996 | Towfigh | A47B 17/02 | 108/108 |
| 6,494,150 | B1 * | 12/2002 | Phoenix | A47B 51/00 | 108/147 |
| 6,550,724 | B2 * | 4/2003 | Gosling | A47B 83/001 | 108/144.11 |
| 7,676,992 | B2 * | 3/2010 | Burns | E04F 13/081 | 52/35 |
| 8,967,057 | B2 * | 3/2015 | Quiring | B66F 7/0666 | 108/145 |
| 9,693,624 | B2 * | 7/2017 | Mitchell | A47B 5/00 | |
| 9,980,559 | B2 * | 5/2018 | Randolph | A47B 21/04 | |
| 10,098,451 | B2 * | 10/2018 | Keller | A47B 9/02 | |
| 10,104,955 | B2 * | 10/2018 | Keller | A47B 9/12 | |
| 2001/0035114 | A1 * | 11/2001 | Ash | A47B 5/02 | 108/147 |
| 2006/0180057 | A1 * | 8/2006 | Hallman | A47B 5/00 | 108/147 |
| 2011/0089304 | A1 * | 4/2011 | Fenelon | A47B 9/04 | 248/404 |
| 2011/0247532 | A1 * | 10/2011 | Jones | A47B 9/02 | 108/147 |
| 2014/0238279 | A1 * | 8/2014 | Maas | A47B 9/02 | 108/146 |
| 2015/0128832 | A1 * | 5/2015 | Taylor | A47F 3/14 | 108/50.11 |
| 2018/0168334 | A1 * | 6/2018 | Swartz | F16M 13/00 | |

* cited by examiner

WORK STATION WITH IN-WALL HEIGHT-ADJUSTMENT MECHANISM

CROSS-REFERENCE TO RELATED APPLICATIONS

This application claims the benefit of U.S. Provisional Application No. 62/512,310, entitled "WORK STATION WITH IN-WALL HEIGHT-ADJUSTMENT MECHANISM", filed May 30, 2017, which is incorporated herein by reference in its entirety.

FIELD

The specification relates to height-adjustable work stations, and more specifically, to work stations having in-wall height-adjustment mechanisms for raising and lowering work surfaces.

BACKGROUND

Height-adjustable workstations are well known. Such systems are commonly used, for example, in office buildings or in home offices. Conventional height-adjustable workstations are free-standing, and generally include a frame having a pair of spaced apart legs positioned on a floor surface and a work surface mounted atop the frame. One or more actuators for adjusting the height of the work surface are usually mounted within the frame. While such conventional workstations may be positioned near interior walls of an office building or home office, they generally do include any components supported by or mounted internal the interior walls.

SUMMARY

The following summary is intended to introduce the reader to various aspects of the applicant's teaching, but not to define any invention.

According to some aspects, a height-adjustment assembly for a work station includes: (a) a partition wall including an internal wall frame having: a horizontal bottom frame member, a horizontal top frame member above the bottom frame member, and laterally spaced apart first and second vertical frame members extending vertically between the top and bottom frame members. The wall further includes axially opposed first and second exterior wall surfaces mounted to the wall frame and extending laterally from the first vertical frame member to the second vertical frame member and vertically from the bottom frame member to the top frame member. The first and second exterior wall surfaces are spaced axially apart by a wall thickness. The height-adjustment assembly further includes (b) a carriage support located within the wall thickness laterally intermediate the first and second vertical frame members and mounted to the wall frame. The carriage support includes a vertical first track and a vertical second track spaced axially apart from the vertical first track toward the second exterior wall surface. The first track has a first track lateral extent and the second track has a second track lateral extent at least partially overlapping the first track lateral extent. The height-adjustment assembly further includes (c) a first carriage mounted to the carriage support in sliding engagement with the first track and configured to support a first work surface assembly on a first side of the wall; (d) a linear first actuator mounted within the wall thickness and spaced laterally apart from the first and second tracks toward the first vertical frame member, the first actuator coupled to the first carriage and configured to vertically translate the first carriage along the first track for facilitating height adjustment of the first work surface assembly; (e) a second carriage mounted to the carriage support in sliding engagement with the second track and configured to support a second work surface assembly on a second side of the wall opposite the first side; and (f) a linear second actuator mounted within the wall thickness and spaced laterally apart from the first and second tracks toward the second vertical frame member, the second actuator coupled to the second carriage and configured to vertically translate the second carriage along the second track for facilitating height adjustment of the second work surface assembly.

In some examples, the first track extends vertically along a first track centerline and the second track extends vertically along a second track centerline, and wherein the first track centerline and the second track centerline are in lateral alignment.

In some examples, the first track lateral extent and the second track lateral extent are general equal and completely overlap one another.

In some examples, the first carriage includes a first mounting flange projecting axially from the first exterior wall surface for mounting the first work surface assembly to the first carriage, and the second carriage includes a second mounting flange projecting axially from the second exterior wall surface for mounting the second work surface assembly to the second carriage.

In some examples, the first mounting flange has a first flange lateral extent and the second mounting flange has a second flange lateral extent at least partially overlapping the first flange lateral extent.

In some examples, the first mounting flange lateral extent and the second flange lateral extent are generally equal and completely overlap one another.

In some examples, the first track lateral extent overlaps an entirety of the first flange lateral extent, and the second track lateral extent overlaps an entirety of the second flange lateral extent.

In some examples, the first mounting flange projects axially from the first exterior wall surface along a first flange axis and the second mounting flange projects axially from the second exterior wall surface along a second flange axis, and wherein the first and second flange axes are in lateral alignment.

In some examples, the first actuator includes a vertical first ball screw and a first ball nut rotatably coupled to the first ball screw, the first ball nut mounted to the first carriage for vertically translating the first carriage in response to rotation of the first ball screw, and wherein the second actuator includes a vertical second ball screw and a second ball nut rotatably coupled to the second ball screw, the second ball nut mounted to the second carriage for vertically translating the second carriage in response to rotation of the second ball screw.

In some examples, the first carriage includes a first actuator flange extending laterally outboard of the first track toward the first actuator, and the first ball nut is secured to the first actuator flange for vertically translating the first carriage, and wherein the second carriage includes a second actuator flange extending laterally outboard of the second track toward the second actuator, and the second ball nut is secured to the second actuator flange for vertically translating the second carriage.

In some examples, the wall thickness is less than 5 inches.

According to some aspects, a height-adjustable work station includes: (a) a partition wall; (b) at least one in-wall height-adjustment mechanism mounted internal the wall; (c) a first work surface assembly movably supported by the height-adjustment mechanism on a first side of the wall, the height-adjustment mechanism configured for vertically translating the first work surface assembly to facilitate height-adjustment of the first work surface assembly; and (d) a second work surface assembly movably supported by the height-adjustment mechanism on a second side of the wall opposite the first side, the height-adjustment mechanism configured for vertically translating the second work surface assembly to facilitate height-adjustment of the second work surface assembly.

In some examples, an entire weight of the first and second work surface assemblies is borne by the wall.

According to some aspects, a height-adjustable work station includes: (a) a partition wall including an internal wall frame and axially opposed first and second exterior wall surfaces mounted to the wall frame, the first and second exterior wall surfaces spaced axially apart by a wall thickness; (b) a carriage support located within the wall thickness and mounted to the wall frame, the carriage support including a vertical track; (c) a carriage mounted to the carriage support in sliding engagement with the track; (d) a work surface assembly movably supported by the carriage on a first side of the wall; and (e) a linear actuator mounted within the wall thickness and coupled to the carriage, the actuator configured to vertically translate the carriage along the track for facilitating height adjustment of the work surface assembly.

In some examples, the linear actuator is spaced laterally apart from the track.

In some examples, an entire weight of the work surface assembly is borne by the wall.

In some examples, the workstation is free of any independent support separate from the wall for extending between the work surface assembly and a ground surface above which the work surface assembly is positionable.

In some examples, the wall includes a vertical slot in the first exterior wall surface, the carriage includes a mounting flange extending through the slot, and the work surface assembly includes a cantilever support mounted to the flange and a work surface supported by the cantilever support above the flange. The work surface is vertically translatable to a raised position in which the work surface is above a closed upper end of the slot.

In some examples, the work surface is spaced vertically apart from the first mounting flange by a vertical spacing of at least 12 inches.

In some examples, the cantilever support extends between the flange and the work surface along a cantilever axis oriented at an angle of between about 15 and 60 degrees relative to the first exterior wall surface.

In some examples, the first exterior wall surface comprises a first panel extending vertically between a first panel bottom edge and a first panel top edge, and the slot is located vertically intermediate the first panel top and bottom edges. The work surface is above the first panel top edge when in the raised position.

In some examples, the first exterior wall surface comprises at least one second panel above the first panel, the second panel extending vertically between a second panel bottom edge and a second panel top edge and laterally across the first exterior wall surface, and wherein the work surface is vertically intermediate the second panel top and bottom edges when in the raised position.

In some examples, the first panel is detachably mounted to the wall frame for facilitating post-installation access to components internal the wall.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figure 1:
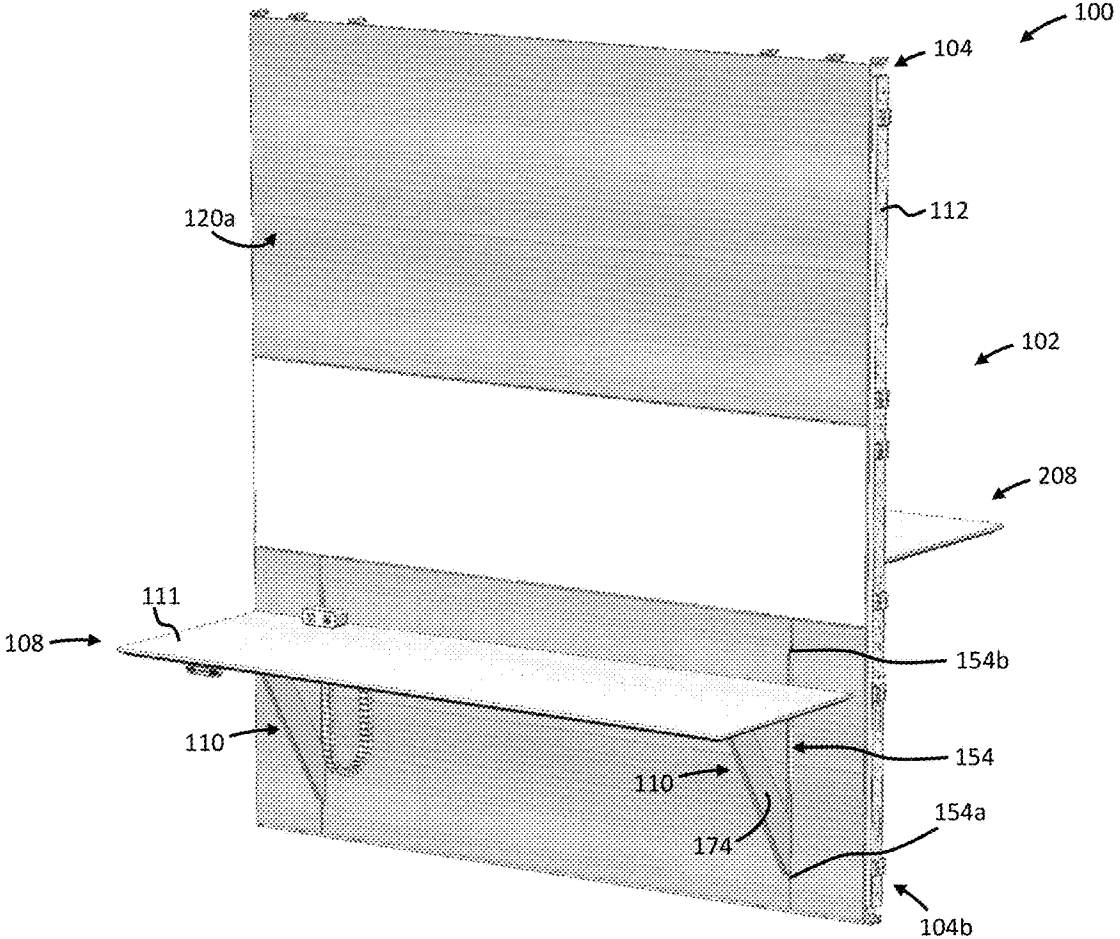
FIG. 1 is a perspective view of a height-adjustable workstation showing a first work surface assembly in a lowered position and a second work surface assembly in a raised position.

Referring to FIG. 1, in the example illustrated, a height-adjustable work station 100 includes a height-adjustment assembly 102 having a partition wall 104 and at least one in-wall height-adjustment mechanism 106 (FIG. 3) mounted internal the wall 104. The work station 100 further includes a first work surface assembly 108 movably supported by the at least one height-adjustment mechanism 106 on a first side 104*a* of the wall 104. The height-adjustment mechanism 106 is configured for vertically translating the first work surface assembly 108 between a lowered position (FIG. 1) and at least one raised position (FIG. 2) to facilitate height-adjustment of the first work surface assembly 108.

Figure 3:
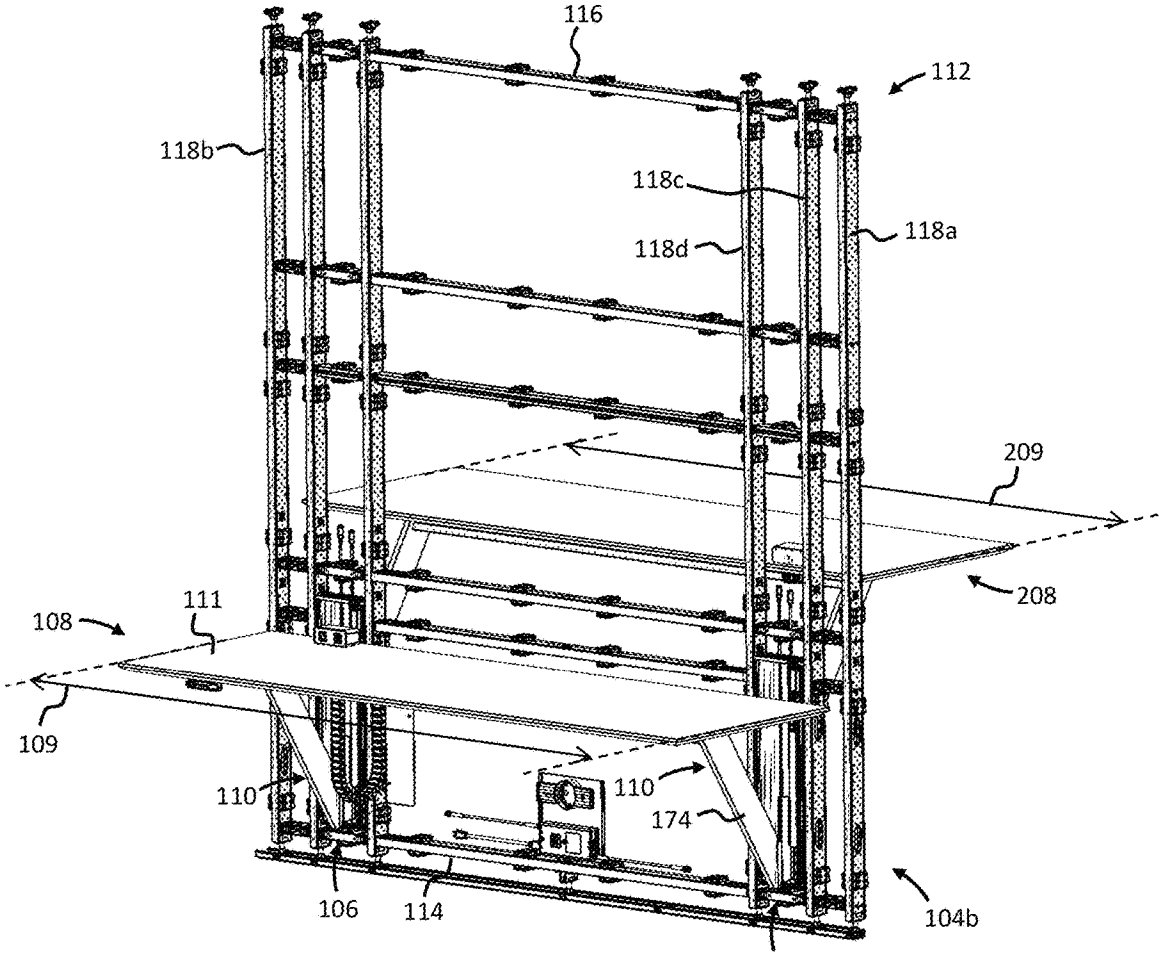
FIG. 3 is a perspective view like that of FIG. 1, but with wall surfaces of the work station omitted.

Referring to FIG. 3, in the example illustrated, the height-adjustment assembly 102 includes a pair of laterally spaced apart height-adjustment mechanisms 106 movably supporting the first work surface assembly 108. The first work surface assembly 108 includes a pair of laterally spaced apart work surface supports 110, each supported on the first side 104*a* of the wall 104 by a respective height-adjustment mechanism 106. The first work surface assembly 108 further includes a work surface 111 supported by the work surface supports 110. The first work surface assembly 108 has a first work surface lateral extent 109 between laterally opposed edges of the work surface 111. In the example illustrated, the pair of height-adjustment mechanisms 106 are similar to one another, and the pair of work surface supports 110 are similar to one another, and only one of the height-adjustment mechanisms 106 will be described in detail herein with respect to one of the work surface supports 110.

Continuing to refer to FIG. 3, in the example illustrated, the wall 104 includes an internal wall frame 112 having a horizontal bottom frame member 114, a horizontal top frame member 116 above the bottom frame member 114, and laterally spaced apart first and second vertical frame members 118*a*, 118*b* extending vertically between the bottom and top frame members 114, 116. Each of the top and bottom frame members 114, 116 can include, for example, a horizontal rail. Each of the vertical frame members 118*a*, 118*b* can include, for example, a stud.

Figure 6:
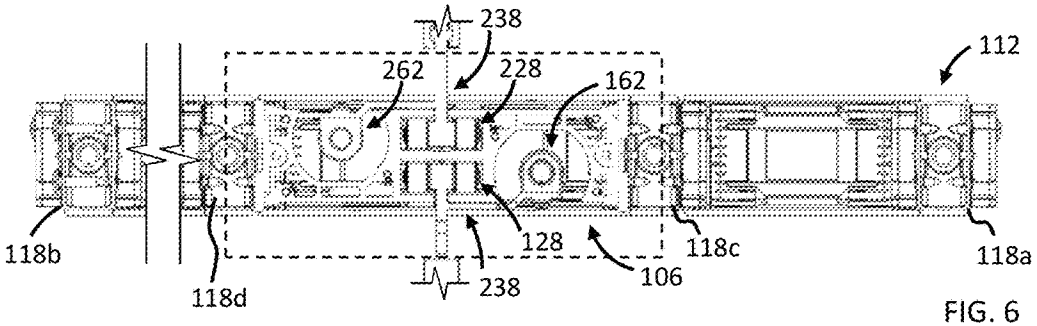
FIG. 6 is a cross-sectional view of portions of the structure of FIG. 3 taken along line 6-6 of FIG. 4.
Figure 6A:
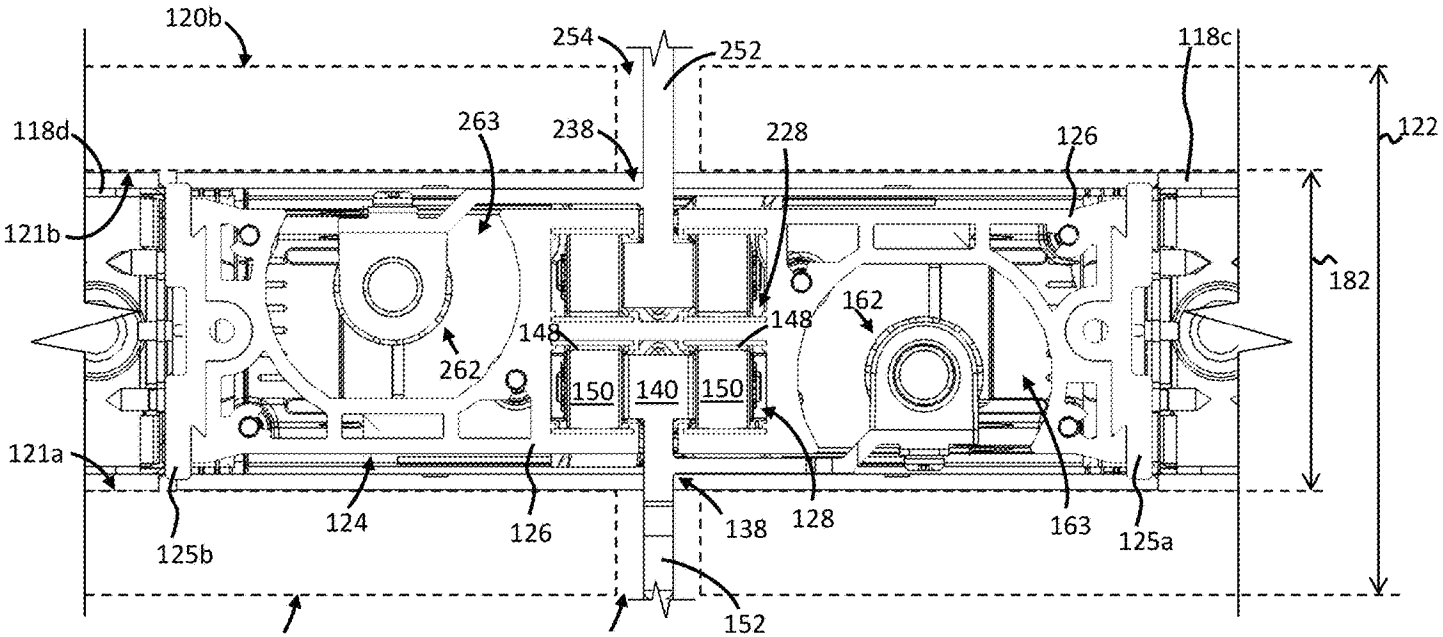
FIG. 6A is an enlarged view of a portion of FIG. 6.

Referring to FIGS. 1 and 6A, the wall 104 further includes axially opposed first and second exterior wall surfaces 120*a*, 120*b* mounted to the wall frame 112 and extending laterally from the first vertical frame member 118*a* to the second vertical frame member 118*b* and vertically from the bottom frame member 114 to the top frame member 116. The first and second exterior wall surfaces 120*a*, 120*b* are spaced axially apart by a wall thickness 122 (FIG. 6A).

Referring to FIGS. 6 and 6A, in the example illustrated, the height-adjustment mechanism 106 includes a carriage support 124 located within the wall thickness 122 and mounted to the wall frame 112. In the example illustrated, the carriage support 124 is located laterally intermediate the first and second vertical frame members 118*a*, 118*b*. In the example illustrated, the wall 104 further includes a pair of laterally spaced apart third and fourth vertical frame members 118*c*, 118*d* laterally intermediate the first and second vertical frame members 118*a*, 118*b*, and the carriage support 124 is positioned laterally intermediate and secured to the third and fourth vertical frame members 118*c*, 118*d*.

Figure 7:
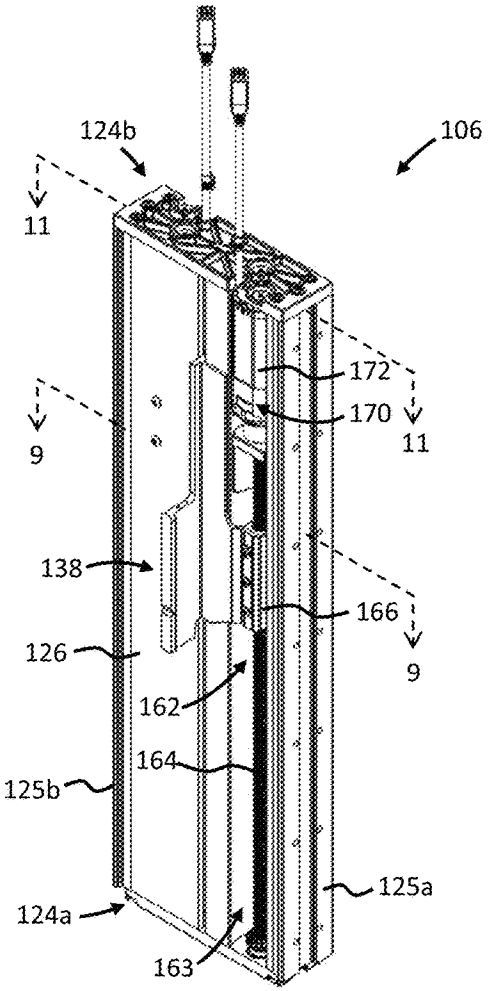
FIG. 7 is a perspective view of a height-adjustment mechanism of the work station of FIG. 1.

Referring to FIGS. 6A and 7, in the example illustrated, the carriage support 124 includes a carriage support frame 126 extending vertically between a carriage support bottom end 124*a* and a carriage support top end 124*b* (FIG. 7). The carriage support 124 further includes a pair of laterally spaced apart first and second support frame mounts 125*a*, 125*b* mounted to the third and fourth vertical frame members 118*c*, 118*d*, respectively (see also FIG. 8). The carriage support frame 126 is positioned laterally intermediate the mounts 125*a*, 125*b*, and is secured to the wall frame 112 through interlocking engagement with the mounts 125*a*, 125*b*, and/or using, for example, any suitable fasteners.

Figure 9:
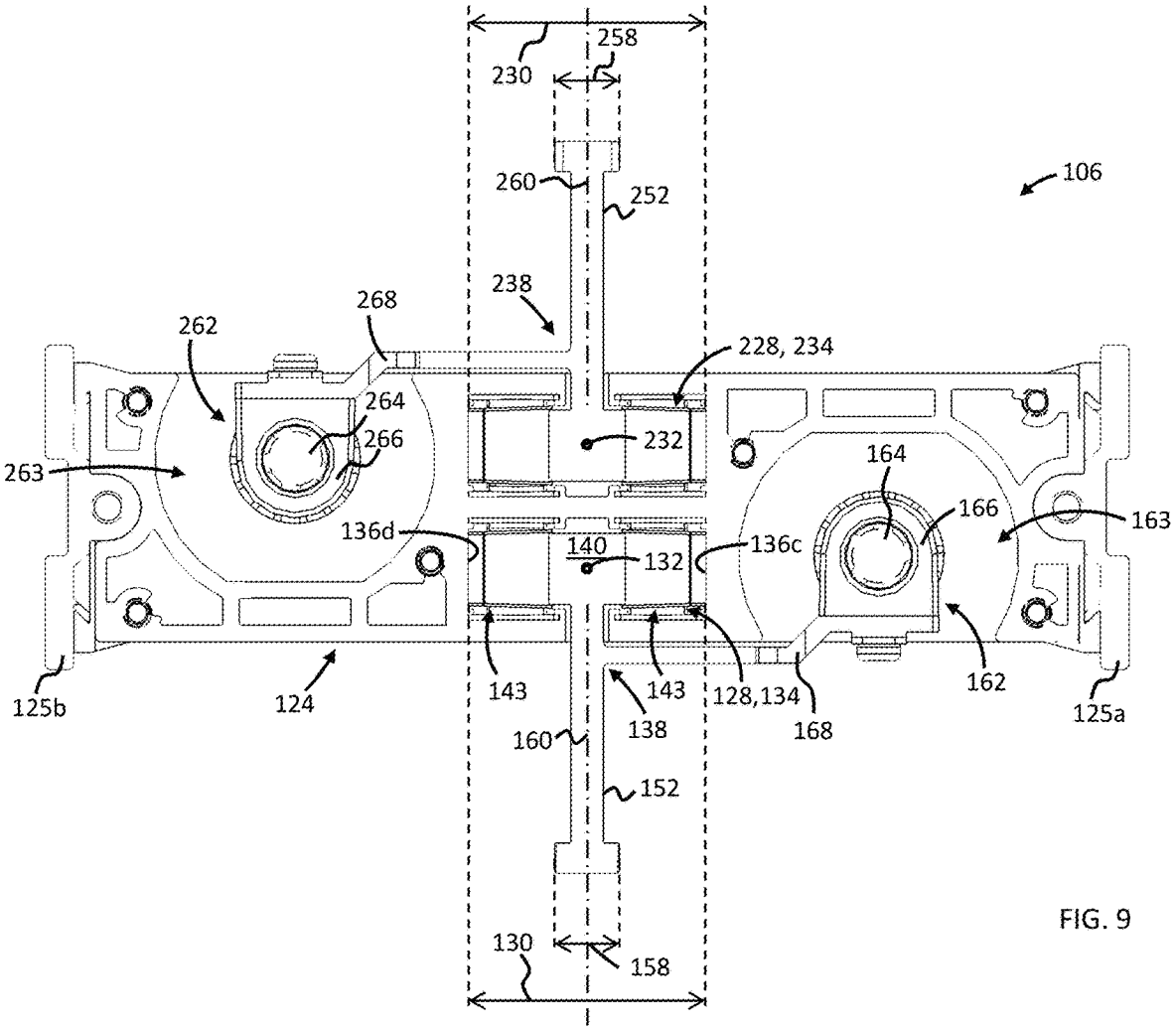
FIG. 9 is a cross-sectional view of the height-adjustment mechanism of FIG. 7 taken along line 9-9 of FIG. 7.
Figure 10:
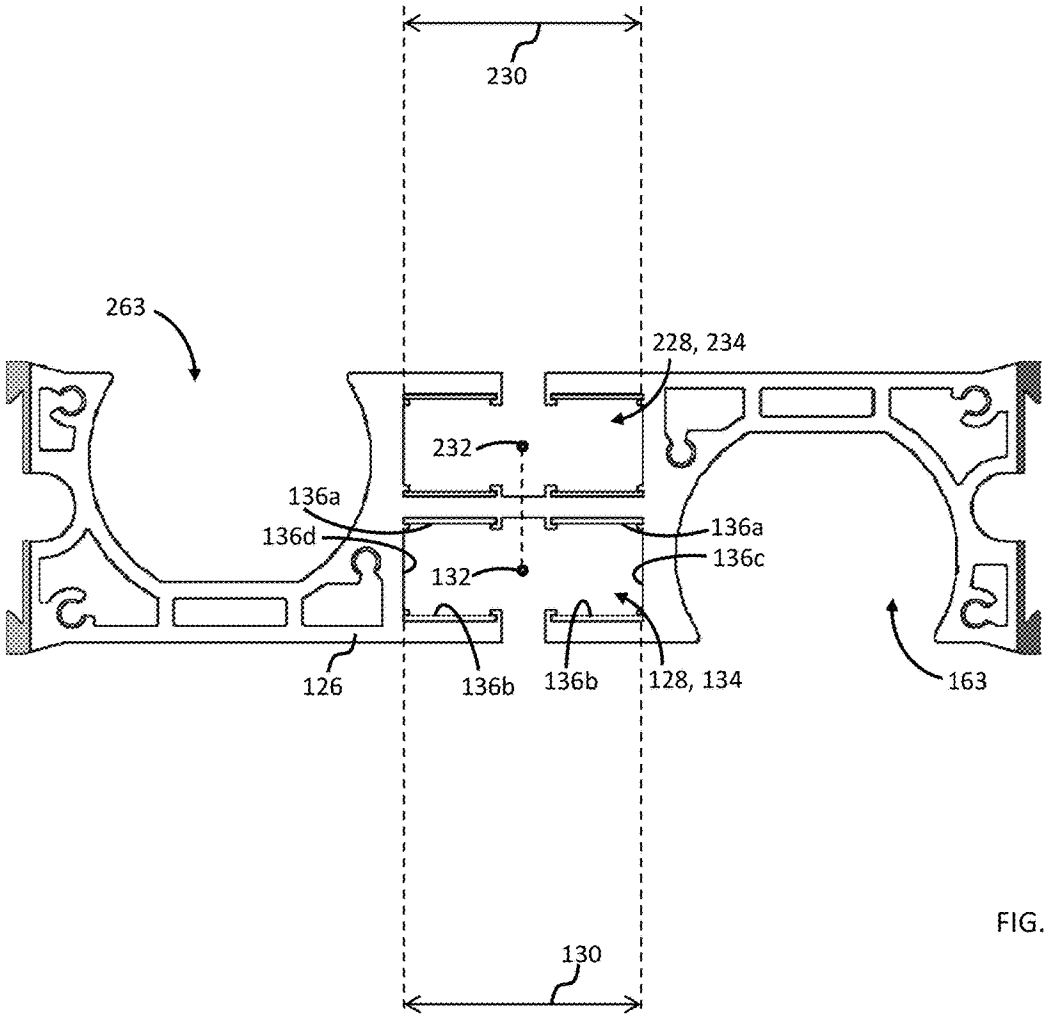
FIG. 10 is a cross-sectional view like that of FIG. 9 showing a frame structure of the height-adjustment mechanism of FIG. 7.

Referring to FIG. 9, in the example illustrated, the carriage support 124 further includes a vertical first track 128 having a first track lateral extent 130, and extending vertically along a first track centerline 132. Referring to FIG. 10, in the example illustrated, the first track 128 includes a first track channel 134 extending vertically through the carriage support frame 126 along the first track centerline 132 between the carriage support bottom and top ends 124*a*, 124*b*. The first track channel 134 is bounded axially by axially spaced apart first and second track surfaces 136*a*, 136*b* fixed relative to the carriage support frame 126. The first track surface 136*a* is directed toward the first work surface assembly 108, and the second track surface 136*b* faces the first track surface 136*a*. The first track channel 134 is bounded laterally by laterally spaced apart third and fourth track surfaces 136*c*, 136*d* fixed relative to the carriage support frame 126. In the example illustrated, the first track lateral extent 130 extends laterally across the first track channel 134 between the third and fourth track surfaces 136*c*, 136*d*.

Referring to FIG. 9, in the example illustrated, a first carriage 138 is mounted to the carriage support 124 in sliding engagement with the first track 128. The first carriage 138 is vertically translatable along the first track 128, and is retained in an axially and laterally fixed position relative to the first track 128. The first carriage 138 is configured to support the first work surface assembly 108 on the first side 104*a* of the wall 104 (see FIG. 3).

Figure 11:
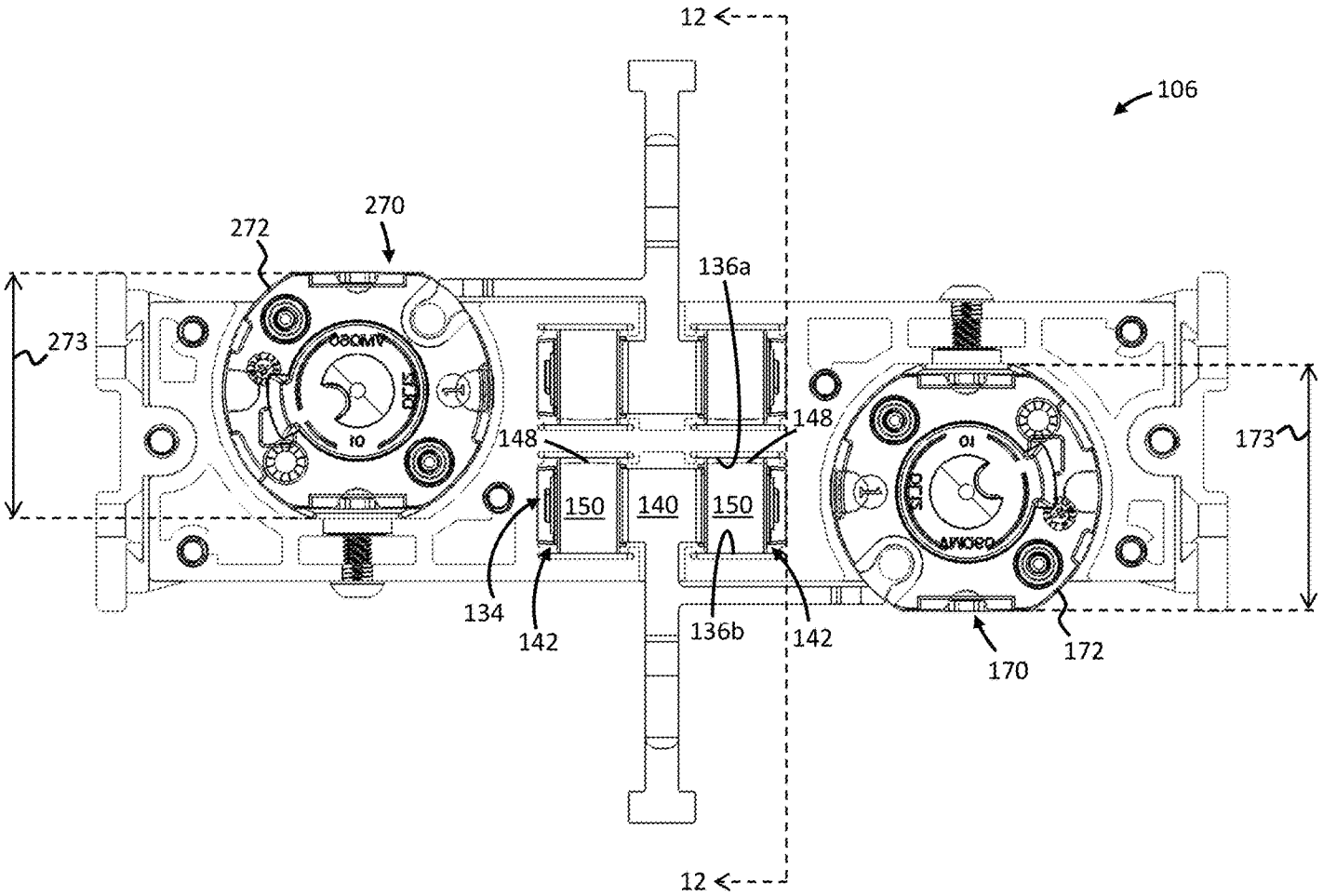
FIG. 11 is a cross-sectional view of the height-adjustment mechanism of FIG. 7 taken along line 11-11 of FIG. 7.

Continuing to refer to FIG. 9, in the example illustrated, the first carriage 138 includes a carriage base 140 positioned in the first track channel 134. Referring to FIG. 11, a plurality of rollers 142 are coupled to the carriage base 140 and located in the first track channel 134 for guiding the first carriage 138 vertically along the first track 128. The rollers 142 can assist in retaining the first carriage 138 in an axially fixed position relative to the first track 128 through engagement with the first and second track surfaces 136*a*, 136*b*. Referring to FIG. 9, in the example illustrated, a plurality of slider blocks 143 are mounted to the carriage base 140 and located in the first track channel 134 for assisting in guiding the first carriage 138 vertically along the track 128. The slider blocks 143 can assist in retaining the first carriage 138 in a laterally fixed position relative to the first track 128 through engagement with the third and fourth track surfaces 136*c*, 136*d*.

Figure 12:
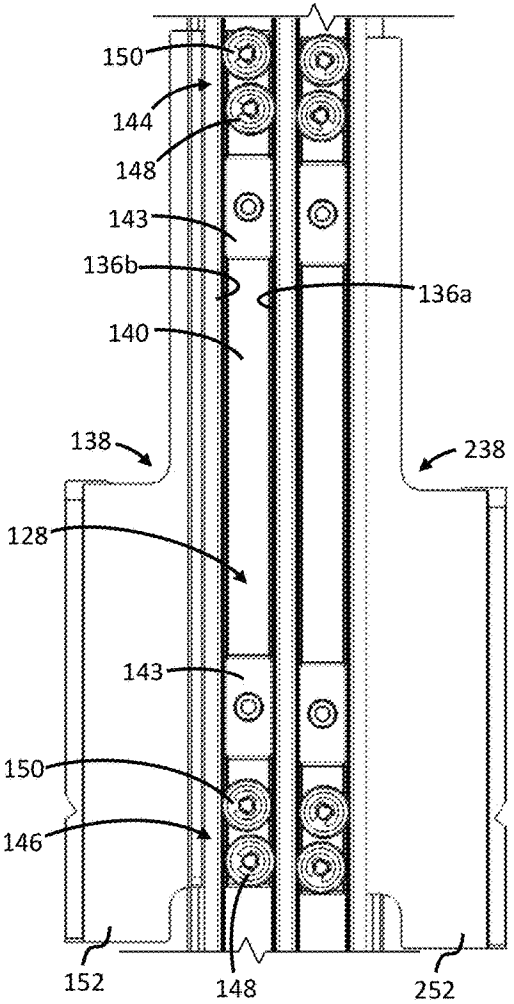
FIG. 12 is a cross-sectional view of the height-adjustment mechanism of FIG. 7 taken along line 12-12 of FIG. 11.

Referring to FIG. 12, in the example illustrated, the plurality of rollers 142 includes an upper set of rollers 144 at an upper end of the carriage base 140, and a lower set of rollers 146 at a lower end of the carriage base 140. In the example illustrated, each of the upper and lower set of rollers 144, 146 includes at least one first roller 148 in engagement with the first track surface 136*a*, and at least one second roller 150 in engagement with the second track surface 136*b*. This arrangement can facilitate smooth travel of the first carriage 138 along the first track 128. In the example illustrated, the first roller 148 of each set is positioned below the second roller 150 of that set. Referring to FIG. 11, in the example illustrated, each of the upper and lower set of rollers 144, 146 includes a pair of laterally spaced apart first rollers 148, and a pair of laterally spaced apart second rollers 150. In the example illustrated, the carriage base 140 is laterally intermediate the rollers of each pair of first and second rollers 148, 150.

Figure 5:
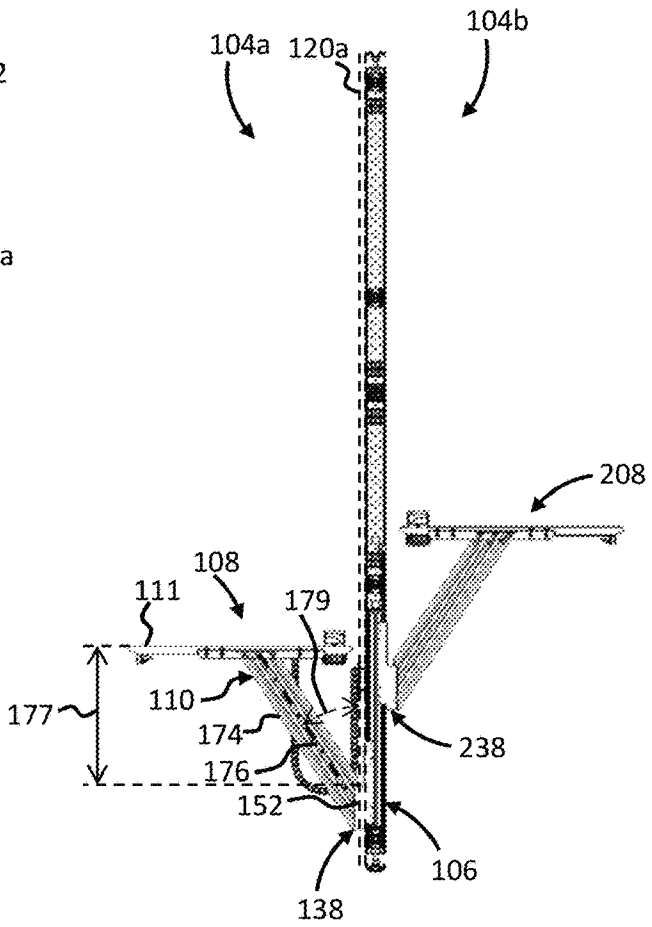
FIG. 5 is a cross-sectional view of the structure of FIG. 3 taken along line 5-5 of FIG. 4.
Figure 4:
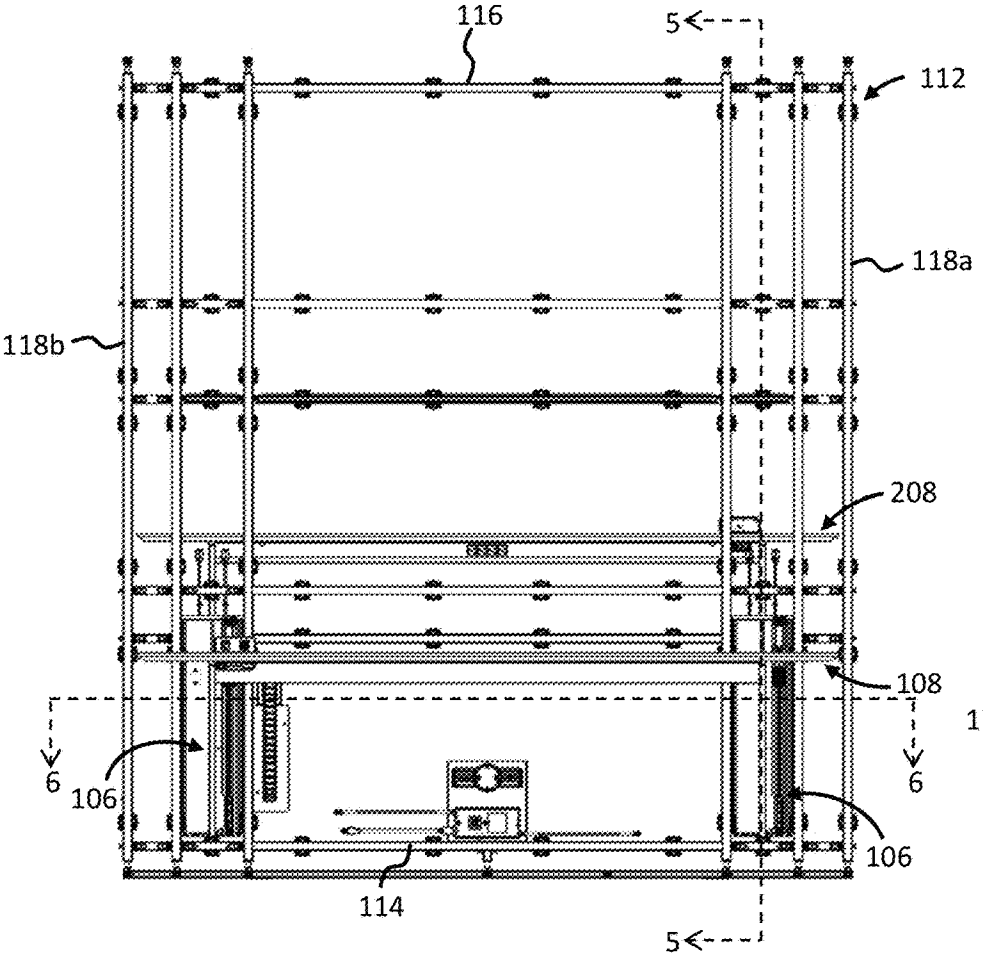
FIG. 4 is a front elevation view of the structure of FIG. 3.

Referring to FIG. 6A, in the example illustrated, the first carriage 138 includes a first mounting flange 152 projecting axially from the first exterior wall surface 120*a* for mounting the first work surface assembly 108 to the first carriage 138 (see also FIGS. 5 and 9). In the example illustrated, the first mounting flange 152 is fixed to the carriage base 140 laterally intermediate the rollers of each pair of first and second rollers 148, 150. In the example illustrated, the wall 104 includes a vertical first slot 154 in the first exterior wall surface 120*a* (see also FIGS. 1 and 2), and the first mounting flange 152 extends axially through the first slot 154. Referring to FIG. 1, in the example illustrated, the first slot 154 extends between a lower end 154*a* and a closed upper end 154*b* above the lower end 154*a*.

Referring to FIG. 9, in the example illustrated, the first mounting flange 152 has a first flange lateral extent 158 between laterally opposed surfaces of the first mounting flange 152. The first flange lateral extent 158 and the first track lateral extent 130 can at least partially overlap. In the example illustrated, the first track lateral extent 130 overlaps an entirety of the first flange lateral extent 158. In the example illustrated, the first mounting flange 152 projects axially from the first exterior wall surface 120*a* along a first flange axis 160. In the example illustrated, the first flange axis 160 intersects the first track lateral extent 130. In the example illustrated, the first flange axis 160 intersects the first track centerline 132.

Figure 8:
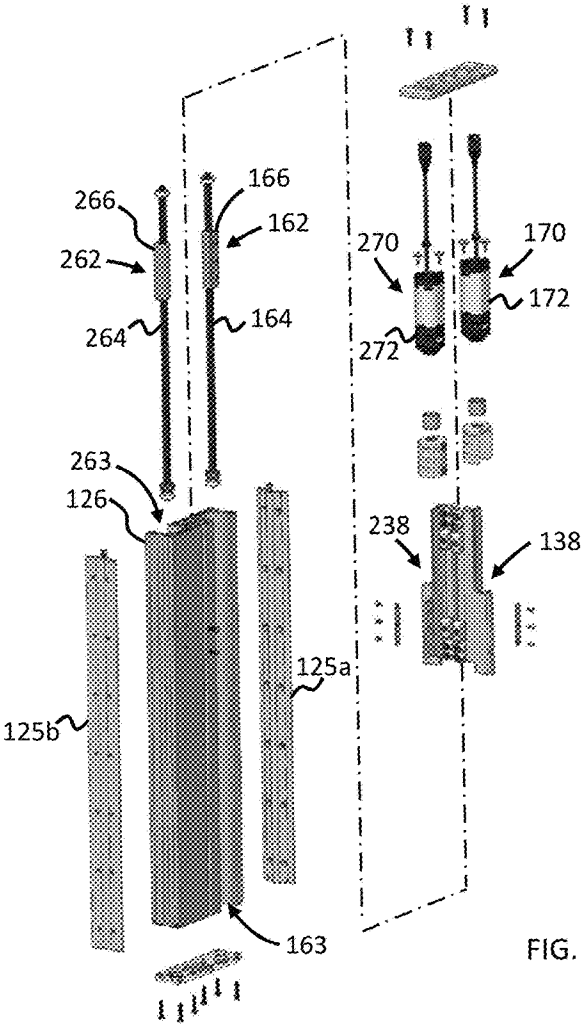
FIG. 8 is an exploded view of the height-adjustment mechanism of FIG. 7.

Referring to FIGS. 6 and 6A, in the example illustrated, the height-adjustment mechanism 106 further includes a linear first actuator 162 mounted within the wall thickness 122 and spaced laterally apart from the first track 128 toward the first vertical frame member 118*a* (see also FIGS. 7 and 8). The first actuator 162 is coupled to the first carriage 138 and configured to vertically translate the first carriage 138 along the first track 128 for facilitating height adjustment of the first work surface assembly 108. In the example illustrated, a first actuator channel 163 extends vertically through the carriage support frame 126 between the carriage support bottom and top ends 124*a*, 124*b*. The first actuator channel 163 is spaced laterally apart from the first track 128 toward the first vertical frame member 118*a* (see also FIGS. 7 and 10). The first actuator 162 is mounted to the carriage support frame 126 within the first actuator channel 163.

Referring to FIG. 9, in the example illustrated, the first actuator 162 includes a vertical first ball screw 164 and a first ball nut 166 rotatably coupled to the first ball screw 164 (see also FIGS. 7 and 8). The first ball nut 166 is mounted to the first carriage 138 for vertically translating the first carriage 138 in response to rotation of the first ball screw 164. In the example illustrated, the first carriage 138 includes a first actuator flange 168 fixed relative to the first mounting flange 152 (and the carriage base 140), and extending laterally outboard of the first track 128 to the first actuator 162. The first ball nut 166 is secured to the first actuator flange 168 for vertically translating the first carriage 138. Referring to FIGS. 7 and 8, a first motor 170 is located within the wall thickness 122 and coupled to the first ball screw 164 for driving rotation of the first ball screw 164. In the example illustrated, the first motor 170 includes a first motor casing 172 positioned above and generally coaxial with the first ball screw 164. The first motor casing 172 is mounted within the first actuator channel 163 of the carriage support frame 126.

Referring to FIG. 5, in the example illustrated, an entire weight of the first work surface assembly 108 is borne by the wall 104, and the work station 100 is free of any independent support structure separate from the wall 104 and extending between the first work surface assembly 108 and a ground surface above which the work surface assembly 108 can be positioned. This can help provide additional leg space and a work station having a more pleasing aesthetic appearance.

In the example illustrated, the work surface support 110 includes a cantilever support 174 mounted to the first mounting flange 152 and supporting the work surface 111 above the first mounting flange 152. This can permit vertical translation of the work surface 111 to a raised position in which the work surface 111 is above the upper end 154*b* of first slot 154 (see FIG. 2), which can provide for a more pleasing aesthetic appearance of the workstation by helping to decrease the visibility of the first slot 154 and/or components of the height-adjustment mechanism 106. In the example illustrated, the work surface 111 is spaced vertically apart from the first mounting flange by a vertical spacing 177. The vertical spacing 177 can be at least 12 inches. In some examples, the vertical spacing 177 is least 18 inches.

Figure 2:
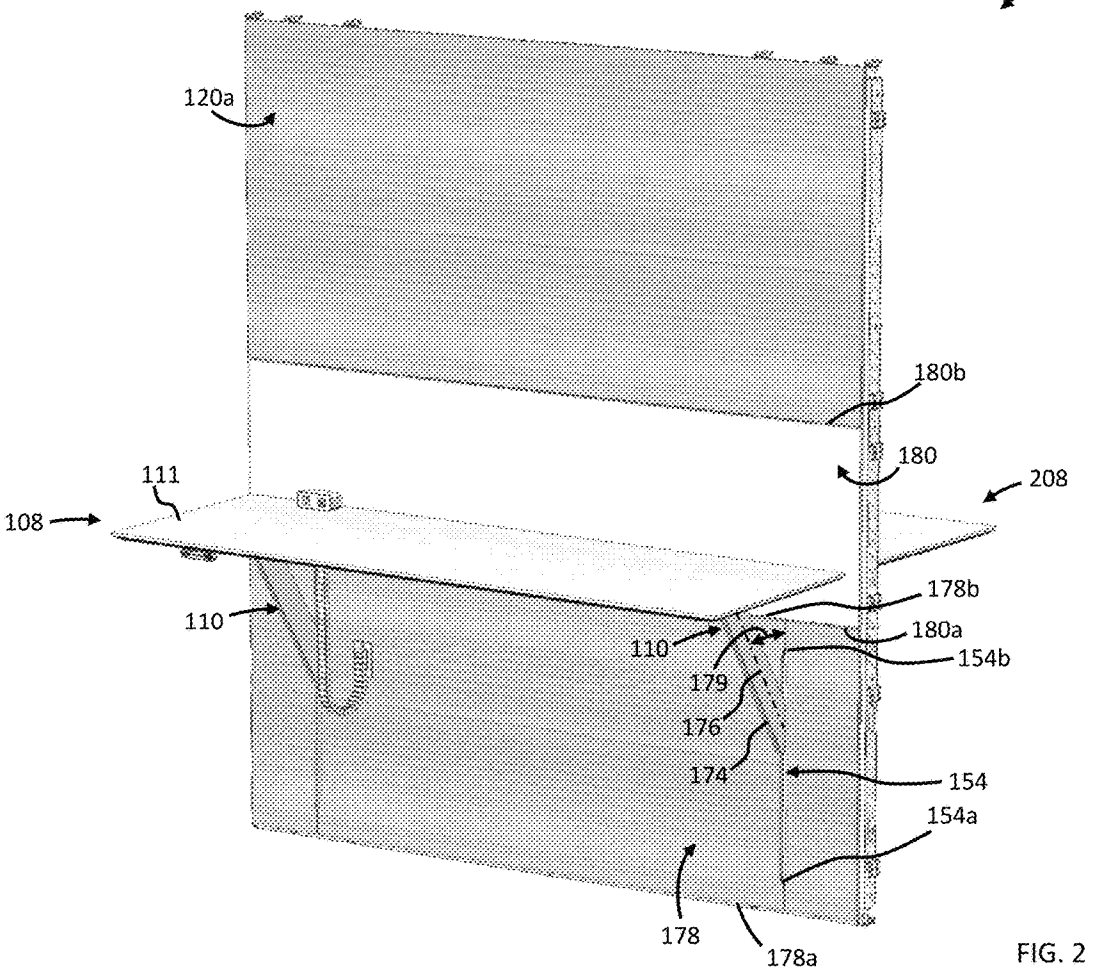
FIG. 2 is a perspective view like that of FIG. 1, but showing the first work surface assembly in a raised position.

In the example illustrated, the cantilever support 174 extends between the first mounting flange 152 and the work surface 111 along a cantilever axis 176 oriented at a cantilever angle 179 relative to the first exterior wall surface 120*a* (see also FIG. 2). The cantilever angle 179 can be between about 15 and 60 degrees. In the example illustrated, the cantilever angle 179 is about 30 degrees.

Referring to FIG. 2, in the example illustrated, the first exterior wall surface 120*a* includes a first panel 178 extending vertically between a first panel bottom edge 178*a* and a first panel top edge 178*b*. The first slot 154 is vertically intermediate the first panel bottom and top edges 178*a*, 178*b*. When in the raised position, the work surface 111 is above the first panel top edge 178*b*. In the example illustrated, the first panel 178 is detachably mounted to the wall frame 112 for facilitating post-installation access to components internal the wall 104.

In the example illustrated, the first exterior wall surface 120*a* further includes at least one second panel 180 above the first panel 178. The second panel extends vertically between a second panel bottom edge 180*a* and a second panel top edge 180*b*, and laterally across the first exterior wall surface 120*a*. In the example illustrated, the second panel 180 is of integral, unitary one-piece construction. When in the raised position, the work surface 111 is vertically intermediate the second panel bottom and top edges 180*a*, 180*b*. The second panel 180 can have a distinct visual appearance from the first panel 178, and can help provide for a more aesthetically pleasing work station.

Referring to FIG. 3, in the example illustrated, the work station 100 further includes a second work surface assembly 208 movably supported by the at least one height-adjustment mechanism 106 on a second side 104*b* of the wall 104 opposite the first side 104*a*. The height-adjustment mechanism 106 is configured for vertically translating the second work surface assembly 208 between a lowered position (like that shown in FIG. 1 with respect to the first work surface assembly 108), and at least one raised position (FIG. 3) to facilitate height-adjustment of the second work surface assembly 208.

In the example illustrated, the second work surface assembly 208 is similar to the first work surface assembly 108, and like features are identified with like reference characters, incremented by 100. The second work surface assembly 208 has a second work surface lateral extent 209, and the first and second work surface lateral extents 109, 209 can at least partially overlap. In the example illustrated, the first and second work surface lateral extents 109, 209 are generally equal and completely overlap one another. In the example illustrated, an entire weight of the second work surface assembly 208 is borne by the wall 104. In the example illustrated, the first and second work surface assemblies 108, 208 are interchangeable, in that each of the first and second work surface assemblies 108, 208 can be supported by the height-adjustment mechanism 106 on either one of the first and second sides 104*a*, 104*b* of the wall 104.

Referring to FIG. 6A, in the example illustrated, the carriage support 124 includes a vertical second track 228 spaced axially apart from the first track 128 toward the second exterior wall surface 120*b* (see also FIG. 10). The second track 228 is similar to the first track 128, and like features are identified by like reference characters, incremented by 100.

Referring to FIG. 9, in the example illustrated, the second track 228 has a second track lateral extent 230 at least partially overlapping the first track lateral extent 130. This can facilitate a work station configuration in which the first and second work surface assemblies are supported on opposite sides of the wall in a back-to-back and laterally overlapping arrangement, which can facilitate more efficient use of office space and can help provide a workstation having a more pleasing aesthetic appearance. In the example illustrated, the second track 228 extends vertically along a second track centerline 232. In the example illustrated, the first track centerline 132 and the second track centerline 232 are in lateral alignment. In the example illustrated, the first track lateral extent 130 and the second track lateral extent 230 are generally equal and completely overlap one another.

In the example illustrated, a second carriage 238 is mounted to the carriage support 124 in sliding engagement with the second track 228. The second carriage 238 is vertically translatable along the second track 228, and is retained in an axially and laterally fixed position relative to the second track 228. The second carriage 238 is configured to support the second work surface assembly 208 on the second side 104*b* (see also FIG. 5) of the wall 104.

In the example illustrated, the second carriage 238 is similar to the first carriage 138, and like features are identified with like reference characters, incremented by 100. In the example illustrated, the first and second carriages 138, 238 are interchangeable, in that each of the first carriage 138 and the second carriage 238 can be mounted to the carriage support 124 in sliding engagement with either one of the first and second tracks 128, 228 for supporting either one of the first and second work surface assemblies 108, 208.

Referring to FIG. 6A, in the example illustrated, the second carriage 238 includes a second mounting flange 252 projecting axially from the second exterior wall surface 120*b* for mounting the second work surface assembly 208 to the second carriage 238. The wall 104 includes a vertical second slot 254 in the second exterior wall surface 120*b*, and the second mounting flange 252 extends axially through the second slot 254.

Referring to FIG. 9, in the example illustrated, the second mounting flange 252 has a second flange lateral extent 258. The second flange lateral extent 258 and the second track lateral extent 230 can at least partially overlap. In the example illustrated, the second track lateral extent 230 overlaps an entirety of the second flange lateral extent 258. The second flange lateral extent 258 can at least partially overlap the first flange lateral extent 158. In the example illustrated, the first flange lateral extent 158 and the second flange lateral extent 258 are generally equal and completely overlap one another.

In the example illustrated, the second mounting flange 252 projects axially from the second exterior wall surface 120*b* along a second flange axis 260. In the example illustrated, the second flange axis 260 intersects the second track lateral extent 230. In the example illustrated, the second flange axis 260 intersects the second track centerline 232. In the example illustrated, the first and second flange axes 160, 260 are in lateral alignment.

Referring to FIGS. 6 and 6A, in the example illustrated, the height-adjustment mechanism 106 further includes a linear second actuator 262 mounted within the wall thickness 122 and spaced laterally apart from the second track 228 toward the second vertical frame member 118*b*. The second actuator 262 is coupled to the second carriage 238 and configured to vertically translate the second carriage 238 along the second track 228 for facilitating height adjustment of the second work surface assembly 208. In the example illustrated, a second actuator channel 263 extends vertically through the carriage support frame 126 between the carriage support bottom and top ends 124*a*, 124*b*. The second actuator channel 263 is spaced laterally apart from the second track 228 toward the second vertical frame member 118*b* (see also FIG. 10). The second actuator 262 is mounted to the carriage support frame 126 within the second actuator channel 263.

In the example illustrated, the first actuator 162 is spaced laterally apart from the first and second tracks 128, 228 toward the first vertical frame member 118*a*, and the second actuator 262 is spaced laterally apart from the first and second tracks 128, 228 toward the second vertical frame member 118*b*. This arrangement can facilitate a reduction in the axial extent of the height-adjustment components located within the wall thickness 122, and can facilitate installation of the height-adjustment mechanism 106 within wall partitions having a relatively short wall thickness. In some examples, the wall thickness can be less than 5 inches. In some examples, the wall thickness can be between 3.5 and 4.5 inches. In the example illustrated, the wall thickness is approximately 4 inches.

Referring to FIG. 9, in the example illustrated, the second actuator 262 includes a vertical second ball screw 264 and a second ball nut 266 rotatably coupled to the second ball screw 264 (see also FIG. 8). The second ball nut 266 is mounted to the second carriage 238 for vertically translating the second carriage 238 in response to rotation of the second ball screw 264. In the example illustrated, the second carriage 238 includes a second actuator flange 268 fixed relative to the second mounting flange 252, and extending laterally outboard of the second track 228 toward the second actuator 262. The second ball nut 266 is secured to the second actuator flange 268 for vertically translating the second carriage 238.

Referring to FIG. 11, in the example illustrated, a second motor 270 is located within the wall thickness 122 and coupled to the second ball screw 264 for driving rotation of the second ball screw 264 (see also FIG. 8). In the example illustrated the second motor 270 includes a second motor casing 272 positioned above and generally coaxial with the second ball screw 264. The second motor casing 272 is mounted within the second actuator channel 263 of the carriage support frame 126.

Still referring to FIG. 11, in the example illustrated, the first motor casing 172 has a first casing axial extent 173 between axially opposed outer surfaces of the first motor casing 172, and the second motor casing 272 has a second casing axial extent 273 between axially opposed outer surfaces of the second motor casing 272. Referring to FIG. 6A, the wall 104 has a first interior wall surface 121*a* opposite the first exterior wall surface 120*a*, and a second interior wall surface 121*b* opposite the second exterior wall surface 120*b* and facing the first interior wall surface 121*a*. The first and second interior wall surfaces 121*a*, 121*b* are spaced axially apart by an interior spacing 182. In the example illustrated, a sum of the first casing axial extent 173 and the second casing axial extent 273 is greater than the interior spacing 182.

In some examples, a height-adjustable work station according to the present teachings can include a single height-adjustment mechanism mounted internal a partition wall and movably supporting a first work surface assembly on one side of the wall, and optionally, a second work surface assembly on an opposite side of the wall. For example, the height-adjustment mechanism may be laterally centered within the wall, and the first work surface assembly (and optionally the second work surface assembly) can include a work surface support mounted to the height-adjustment mechanism, and a work surface having a central portion supported by the work surface support. In some examples, a height-adjustable work station according to the present teachings can include more than two height-adjustment mechanisms 106 mounted internal a partition wall.

The invention claimed is:

1. A height-adjustment assembly for a work station, comprising:

a) a partition wall including an internal wall frame having: a horizontal bottom frame member, a horizontal top frame member above the bottom frame member, and laterally spaced apart first and second vertical frame members extending vertically between the top and bottom frame members, the partition wall further including axially opposed first and second exterior wall surfaces mounted to the internal wall frame and extending laterally from the first vertical frame member to the second vertical frame member and vertically from the bottom frame member to the top frame member, the first and second exterior wall surfaces spaced axially apart by a wall thickness;

b) a carriage support located within the wall thickness laterally intermediate the first and second vertical frame members and mounted to the internal wall frame, the carriage support including a vertical first track and a vertical second track spaced axially apart from the vertical first track toward the second exterior wall surface, the vertical first track having a first track lateral extent and the vertical second track having a second track lateral extent at least partially overlapping the first track lateral extent;

c) a first carriage mounted to the carriage support in sliding engagement with the vertical first track and configured to support a first work surface assembly on a first side of the partition wall;

d) a linear first actuator mounted within the wall thickness and spaced laterally apart from the vertical first and second tracks toward the first vertical frame member, the linear first actuator coupled to the first carriage and configured to vertically translate the first carriage along the vertical first track for facilitating height adjustment of the first work surface assembly;

e) a second carriage mounted to the carriage support in sliding engagement with the vertical second track and configured to support a second work surface assembly on a second side of the partition wall opposite the first side; and f) a linear second actuator mounted within the wall thickness and spaced laterally apart from the vertical first and second tracks toward the second vertical frame member, the linear second actuator coupled to the second carriage and configured to vertically translate the second carriage along the vertical second track for facilitating height adjustment of the second work surface assembly.

2. The assembly of claim 1, wherein the vertical first track extends vertically along a first track centerline and the vertical second track extends vertically along a second track centerline, and wherein the first track centerline and the second track centerline are in lateral alignment.

3. The assembly of claim 1, wherein the first track lateral extent and the second track lateral extent are generally equal and completely overlap one another.

4. The assembly of claim 1, wherein the first carriage includes a first mounting flange projecting axially from the first exterior wall surface for mounting the first work surface assembly to the first carriage, and the second carriage includes a second mounting flange projecting axially from the second exterior wall surface for mounting the second work surface assembly to the second carriage.

5. The assembly of claim 4, wherein the first mounting flange has a first flange lateral extent and the second mounting flange has a second flange lateral extent at least partially overlapping the first flange lateral extent.

6. The assembly of claim 5, wherein the first mounting flange lateral extent and the second flange lateral extent are generally equal and completely overlap one another.

7. The assembly of claim 5, wherein the first track lateral extent overlaps an entirety of the first flange lateral extent, and the second track lateral extent overlaps an entirety of the second flange lateral extent.

8. The assembly of claim 4, wherein the first mounting flange projects axially from the first exterior wall surface along a first flange axis and the second mounting flange projects axially from the second exterior wall surface along a second flange axis, and wherein the first and second flange axes are in lateral alignment.

9. The assembly of claim 1, wherein the linear first actuator includes a vertical first ball screw and a first ball nut rotatably coupled to the first ball screw, the first ball nut mounted to the first carriage for vertically translating the first carriage in response to rotation of the first ball screw, and wherein the linear second actuator includes a vertical second ball screw and a second ball nut rotatably coupled to the second ball screw, the second ball nut mounted to the second carriage for vertically translating the second carriage in response to rotation of the second ball screw.

10. The assembly of claim 9, wherein the first carriage includes a first actuator flange extending laterally outboard of the vertical first track toward the linear first actuator, and the first ball nut is secured to the first actuator flange for vertically translating the first carriage, and wherein the second carriage includes a second actuator flange extending laterally outboard of the vertical second track toward the linear second actuator, and the second ball nut is secured to the second actuator flange for vertically translating the second carriage.

11. The assembly of claim 1, wherein the wall thickness is less than 5 inches.

* * * * *